United States Patent [19]

Desaau

[11] 4,356,079

[45] Oct. 26, 1982

[54] DENITRIFICATION OF HYDROCARBON FEEDSTOCK

[75] Inventor: Ralph M. Desaau, Edison, N.J.

[73] Assignee: Mobil Oil Corporation, New York, N.Y.

[21] Appl. No.: 156,283

[22] Filed: Jun. 4, 1980

[51] Int. Cl.[3] ..... C10G 17/00; C10G 23/02

[52] U.S. Cl. ..... 208/10; 44/1 B; 208/254 H

[58] Field of Search ..... 208/254 H, 10; 44/1 B, 44/51

[56] References Cited

U.S. PATENT DOCUMENTS

| | | | |
|---|---|---|---|
| 3,364,133 | 1/1968 | Young et al. | 208/254 H |
| 3,926,780 | 12/1975 | Ward | 208/254 H |
| 4,138,326 | 2/1979 | Swift et al. | 208/254 H |
| 4,153,540 | 5/1979 | Gorring et al. | 208/254 H |
| 4,200,521 | 4/1980 | Stein et al. | 208/254 H |

OTHER PUBLICATIONS

Perry, *Chemical Engineers' Handbook,* Third Edition, (1950), McGraw-Hill Book Co., Inc., pp. 1560-1564, 1568-1570.

Kirk-Othmer, Encyclopedia of Chemical Technology, Second Edition, vol. 11, (1966), pp. 366, 367, Interscience Publishers.

*Primary Examiner*—O. R. Vertiz
*Assistant Examiner*—Wayne A. Langel
*Attorney, Agent, or Firm*—Charles A. Huggett; Michael G. Gilman; Charles J. Speciale

[57] ABSTRACT

This invention provides a method for reducing the nitrogen content of a heavy hydrocarbonaceous feedstock, which involves contacting the feedstock with hydrogen and water in the presence of a hydrogenation catalyst and a steam stable acidic zeolite catalyst.

The invention process is applicable to the denitrification of raw coal, and syncrude feed derived from oil shale and tar sands.

17 Claims, No Drawings

DENITRIFICATION OF HYDROCARBON FEEDSTOCK

BACKGROUND OF THE INVENTION

Conversion of heavy hydrocarbon fractions by the hydrocracking technique is complicated by the presence of certain contaminants in heavier hydrocarbon fractions and refinery products. Petroleum crude oils and the heavier hydrocarbon fractions and/or distillates obtained therefrom, particularly heavy vacuum gas oils, oil extracted from tar sands, and topped or reduced crudes, contain nitrogenous, sulfurous, and organo-metallic compounds in large quantities. The presence of sulfur- and nitrogen-containing and organo-metallic compounds in crude oils and various hydrocarbon fractions is a disadvantage.

Nitrogen is undesirable because it effectively poisons various catalytic composites which may be employed in the conversion of heavy hydrocarbon fractions. In particular, nitrogen-containing compounds are effective in suppressing hydrocracking. Further, nitrogenous compounds are objectionable because combustion of fuels containing these impurities possibly contributes to the release of nitrogen oxides which are noxious and corrosive and present a serious problem with respect to pollution of the atmosphere. Consequently, removal of the nitrogeneous contaminants is highly advantageous, and it makes the treatment of contaminated stocks practical and economically attractive.

Because of these adverse effects, repeated attempts have been made to remove the nitrogen compounds from hydrocarbon feedstocks in refining processes and from the products produced. For example, acid treating with dilute sulfuric acid forms water soluble salts with the basic nitrogen compounds, i.e. the nitrogen bases or amines. It is otherwise ineffective with respect to the nonbasic nitrogen compounds. Catalytic hydrogenation is effective to remove most all of the nitrogen compounds, but in order to reduce their incidence in the hydrogenated product to a level which does not adversely affect a platinum catalyzed reforming process for gasoline, hydrogenation pressures of the order of 5000 psi and higher are required. Treatment of such materials with fuller's earth tends to reduce the quantity of nitrogen compounds, but this involves a relatively high liquid yield loss through retention of hydrocarbons on the adsorbent, and the nitrogen compounds are lost through disposal of the spent adsorbent. Various other petroleum residua and syncrude denitrification methods have been developed as exemplified by the following prior art technology.

U.S. Pat. No. 2,518,353 describes a process in which a hydrocarbon feed containing basic nitrogen compounds is contacted with an aqueous solution of an amine salt. The basic nitrogen compounds are extracted into the aqueous phase, thereby reducing the nitrogen content of the hydrocarbon raffinate phase.

U.S. Pat. No. 2,719,110 describes a method of treating heavy naphtha containing substantial amounts of pyrroles and nitrogen bases, which comprises contacting the naphtha with molten potassium hydroxide to extract the pyrroles from the naphtha, and in a second step contacting the naphtha with sulfuric acid to extract the nitrogen bases from the naphtha.

U.S. Pat. No. 2,729,595 describes a process for denitrifying a nitrogen-containing hydrocarbon oil by contacting the oil at 650°-750° F. with a reagent selected from iodine and hydrogen iodide. The reagent reacts selectively with the nitrogen contaminants to form a tarry precipitate.

U.S. Pat. No. 2,907,710 describes a process in which a hydrocarbon oil is treated with an organic isocyanate reagent to convert oxygen, sulfur and nitrogen compounds in the oil into derivatives which are less objectionable or which can be selectively removed from the oil. The reaction is catalyzed by water or a strong base.

U.S. Pat. Nos. 2,925,375; 2,925,379; 2,925,381; and 2,999,861 disclose the use of a partially dehydrated zeolite to adsorb nitrogen compounds selectively from a hydrocarbon stream in the vapor phase.

U.S. Pat. No. 2,981,678 describes a process for removing basic nitrogen compounds from a liquid hydrocarbon by passage of the hydrocarbon through a solid bed of alkaline bisulfate to convert the nitrogen compounds to a water-soluble product which is separated as a solute in an aqueous phase.

U.S. Pat. No. 3,162,598 describes a method for reducing the nitrogen content of hydrocarbon feedstocks by oxidizing the nitrogen-containing contaminants with a mixture of chromic acid and a concentrated aqueous solution of hydrogen peroxide.

There are several prior art references which relate to methods for hydrogenating, cracking, desulfurizing, denitrifying, demetalating and generally upgrading hydrocarbon mixtures by processes involving the presence of water. U.S. Pat. No. 3,453,206 discloses a multistage process for hydrofining heavy hydrocarbon feedstocks to reduce the concentration of sulfur, nitrogen and organometallic contaminants contained therein. In a first stage, a hydrocarbon feedstock is reacted with hydrogen in the presence of water. In a second stage, the hydrocarbon feedstock is hydrofined in the presence of a catalytic composite of a metallic hydrogenation component and a refractory inorganic oxide carrier.

U.S. Pat. No. 3,501,396 discloses a process for desulfurizing and denitrifying a hydrocarbon oil which involves hydrofining the oil in the presence of water and in contact with a catalytic composite of metallic hydrogenation component and an acidic carrier component. Ammonia and hydrogen sulfide are produced as byproducts of the hydrofining process.

U.S. Pat. No. 3,960,706 describes a process for upgrading a hydrocarbon fraction and for generating hydrogen in situ. A hydrocarbon fraction containing sulfur and nitrogen contaminants is contacted with a dense water-containing phase in the absence of supplied hydrogen and in the presence of a catalytic composite of a transition metal and a refractory substrate.

U.S. Pat. No. 4,071,435 describes a process for denitrification of a syncrude feed wherein the syncrude is mixed with an extractant-catalyst which is effective for extracting nitrogen contaminants from the syncrude and also for functioning as a hydrocracking catalyst. The admixing procedure forms a first phase composed of a low nitrogen syncrude, and a second phase composed of the extractant catalyst and high nitrogen syncrude feed. The said second phase is separated and hydrocracked to yield a low nitrogen syncrude product.

There is continuing research effort to develop processes for upgrading hydrocarbon feedstocks with improved efficiency and convenience.

Accordingly, it is an object of this invention to provide an improved process for upgrading of hydrocarbonaceous fractions such as syncrude, petroleum refinery residuum, coal, and the like, which contain undesirable sulfur, nitrogen and metal contaminants.

It is another object of this invention to provide an improved process for denitrification of hydrocarbon feedstocks which contain nonbasic nitrogen compounds such as pyridine and pyrrole derivatives.

It is a further object of this invention to provide an improved hydrofining process for upgrading hydrocarbon feedstock, in which process the nitrogen content of the feedstock is lowered under moderate pressure and without a high consumption of hydrogen.

Other objects and advantages shall become apparent from the accompanying description and examples.

DESCRIPTION OF THE INVENTION

One or more objects of the present invention are accomplished by the provision of a process for denitrification of a hydrocarbon feedstock which comprises contacting the feedstock with hydrogen and water at a temperature between about 500° F. and 850° F. in the presence of a hydrogenation catalyst and an acidic zeolite catalyst.

It is an important feature of the invention process that the presence of water during the hydrofining phase permits the use of milder temperature and pressure conditions and reduces the amount of hydrogen consumed in accomplishing the desired conversion and removal of nonbasic nitrogen-containing heterocycle contaminants from a hydrocarbon feedstock. Effectively, the formation of light gas by hydrocracking is minimized by the presence of water, and the denitrification reactivity is enhanced.

In prior art processes for nitrogen and sulfur removal from petroleum refinery residua, syncrude, coal, and the like, hydrofining over cobalt/molybdenum type catalysts is generally employed. In these hydrofining procedures, considerable hydrogen is consumed, in a quantity that is many times greater than that required on the basis of stoichiometry alone. This is especially evident when extensive nitrogen removal is desired. It appears that aromatic nitrogen heterocycles require complete double bond saturation prior to nitrogen atom scission. Also, in the prior art processes much of the hydrogen is consumed in the production of gaseous and low-boiling hydrocarbons due to the high temperature hydrofining conditions employed.

In accordance with the present invention hydrofining process, two factors favor a lower consumption of hydrogen. Firstly, the process is amenable to milder temperature and pressure conditions, which functions to suppress the production of light end products. Secondly, in the presence of water and an acidic zeolite catalyst, hydrolytic denitrification of pyridine and pyrrole derivatives is promoted in the process:

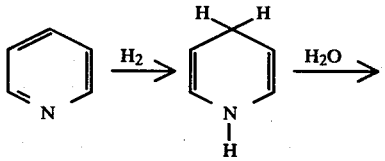

(1)

-continued

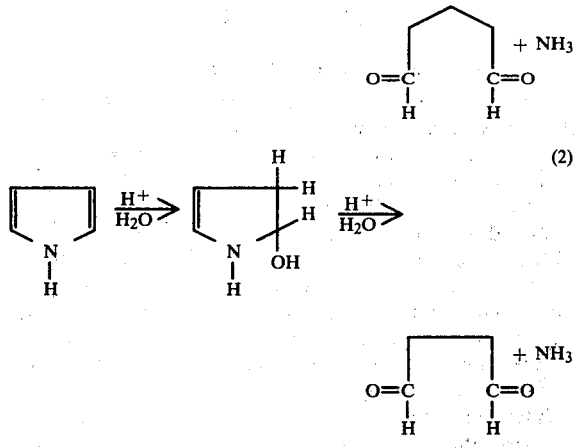

(2)

The feasibility of the above described hydrolytic denitrification is dependent on the conversion of aromatic nitrogen heterocycles into intermediate imine and enamine structures.

Hydrocarbon Feedstocks

The present invention process has particular advantage for the hydrofining of heavy hydrocarbon mixtures having a boiling range above about 400° F., and an end boiling point up to about 1000° F. Suitable hydrocarbon feedstocks include straight-run gas oil and heavy naphthas, coker distillate gas oils and heavy naphthas, deasphalted crude oils, cycle oils derived from catalytic or thermal cracking operations, and the like. The feedstock may be derived from petroleum crude oils, shale oils, tar sand oils, coal liquefaction liquids, and other heavy fractions and distillates which contain a high level of nitrogenous, sulfurous and organometallic contaminants. As described more fully hereinafter, the invention process is applicable for hydrofining of raw coal.

Heavy hydrocarbon feedstocks of the kind enumerated above typically will contain between about 0.01 and 5 weight percent of sulfur, and between about 0.01 and 4 weight percent of nitrogen. It is a particular advantage of the present invention process that the nitrogen content of a hydrocarbon feedstock can be reduced by at least about 40 percent, and in some cases by as much as about 70 percent.

An economically significant type of heavy hydrocarbon feedstocks are the refractory polycyclic aromatic mixtures which result from one or more petroleum operations. Representative of this type of residuum feedstock are asphalt, alkane-deasphalted tar, coker gas oil, heavy cycle oil, fluidized catalytic cracking (FCC) main column bottoms, thermofor catalytic cracking (TCC) syntower bottoms, and clarified slurry oil.

The nominal properties of various of these feedstocks are as follows:

| TCC Syntower Bottoms | |
|---|---|
| Sulfur | 1.13% |
| Nitrogen | 450 ppm |
| Pour Point | 50° F. |
| 5% Boiling Point | 640° F. |
| 95% Point | 905° F. |
| Conradson Carbon | 9.96 |
| **Clarified Slurry Oil** | |
| Sulfur | 1.04% |

-continued

| | |
|---|---|
| Nitrogen | 4400 ppm |
| Pour Point | 50° F. |
| 5% Boiling Point | 630° F. |
| 95% Point | 924° F. |
| Conradson Carbon | 10.15 |
| Heavy Cycle Oil | |
| Sulfur | 1.12% |
| Nitrogen | 420 ppm |
| 5% Boiling Point | 450° F. |
| 95% Point | 752° F. |
| Conradson Carbon | 10.15 |

A typical FCC main column bottoms has the following nominal analysis and properties:

| | |
|---|---|
| Elemental Analysis, Wt. %: | |
| C | 89.93 |
| H | 7.35 |
| O | 0.99 |
| N | 0.44 |
| S | 1.09 |
| Total | 99.80 |
| Pour Point, °F.: 50 | |
| CCR, %: 9.96 | |
| Distillation: | |
| IBP, °F.: 490 | |
| 5%, °F.: 640 | |
| 95%, °F.: 905 | |

An FCC main column bottoms product is obtained by the fluidized catalytic cracking of gas oil in the presence of a solid porous catalyst, and separation of the products of cracking in a product fractionator. A more complete description of the production of this petroleum by-product stream is disclosed in U.S. Pat. No. 3,725,240.

Water and Hydrogen Components

The presence of water is an essential feature of the invention hydrofining process. Normally the water is first converted to steam, and then introduced into the hydrofining zone either via a separate line or in admixture with the hydrogen stream.

The water is introduced into the hydrofining zone in a quantity which can vary broadly within the range between about 0.05 and 20 weight percent, and preferably is maintained in the range between about 0.1 and 5 weight percent, based on the weight of hydrocarbon feedstock. In calculating the weight percent water requirement, it is advantageous to allow for residual water contained in the feedstock, and for any water which is generated in situ during the hydrofining cycle of the process. Illustrative of in situ water generating precursors are carbon dioxide, carbon monoxide, alcohols, ketones, aldehydes, esters, and the like.

The hydrogen component of the process is supplied in a hydrogen/oil ratio between about 300 and 15,000 s.c.f./barrel, and preferably in a hydrogen/oil ratio between about 500 and 10,000 s.c.f./barrel.

Catalyst System

In one embodiment, the catalyst system employed in the hydrofining process comprises a hydrogenation catalyst component and an acidic zeolite catalyst component.

The hydrogenation catalyst component can be any of the oxides and/or sulfides of the transitional metals, and especially an oxide or sulfide of a Group VIII metal (particularly iron, cobalt or nickel) mixed with an oxide or sulfide of a Group VIB metal (preferably molybdenum or tungsten). Such catalysts may be employed in undiluted form, but preferably are supported on an adsorbent carrier in proportions ranging between about 0.5 and 30 weight percent. Suitable carriers include the difficultly reducible inorganic oxides, e.g., alumina, silica, zirconia, titania, clays such as bauxite, bentonite, and the like. The preferred carrier is activated alumina, and especially activated alumina containing about 5–35 weight percent of coprecipitated silica gel.

A preferred hydrogenation catalyst component consists of cobalt oxide or sulfide plus molybdenum oxide or sulfide supported on silica-stabilized alumina. Compositions containing between about 2 and 8 percent of CoO, 4 and 20 percent of $MoO_3$, 3 and 15 percent of $SiO_2$, and the balance $Al_2O_3$, are of particular value.

If the hydrogenation catalyst component is employed is undiluted form, the proportion of this component in the catalyst system can be varied in the range between about 5 and 25 weight percent, based on the combined weight of hydrogenation catalyst and acidic zeolite catalyst in the system. If the hydrogenation catalyst component is supported on a carrier substrate as described above, then the proportions of hydrogenation catalyst and acidic zeolite components are calculated so as to provide at least 30 weight percent of acidic zeolite component in the catalyst system.

The presence of the acidic zeolite component in the catalyst system is an essential feature of the invention hydrofining process. A preferred acidic zeolite is one which is a steam stable crystalline aluminosilicate composition having a silica/alumina ratio above about 5, and preferably above about 8. Further, it is preferred that the steam stable acidic zeolite component of the catalyst system has an alpha value in the range between about 1 and 1000, and most preferably in the range between about 50 and 200.

The term "alpha value" is defined in a paper entitled "Superactive Crystalline Aluminosilicate Hydrocarbon Catalysts", published in the Journal of Catalysts, 4, No. 4 (August 1965). "Alpha value" is the measure of the conversion ability of a particular superactive catalyst when compared with a conventional high activity silica-alumina cracking catalyst (90% S102–10% A102) having an activity index as measured by the Cat. A test of about 46. Superactive catalysts are described in U.S. Pat. Nos. 3,413,212 and 3,533,936.

The acidic zeolite catalyst component can be either a natural or synthetic aluminosilicate composition. Illustrative of synthetic zeolite catalysts suitable for the practice of the invention hydrofining process are the acidic forms of various crystalline aluminosilicates known in the prior art, such as zeolite X, zeolite Y, ZSM-8, ZSM-11, ZSM-12, ZSM-32, and the like.

The preparation of specific types of crystalline aluminosilicates is described in U.S. Pat. Nos. such as 3,882,243 (zeolite A); 2,882,244 (zeolite X); 3,130,007 (zeolite Y); 3,055,654 (zeolite K-G); 3,247,195 (zeolite ZK-5); 3,308,069 (zeolite Beta); 3,314,752 (zeolite ZK-4); 3,702,886 (ZSM-5); and references cited therein, incorporated herein by reference.

In a particularly preferred embodiment of the invention process, the function of each of the hydrogenation component and the acidic zeolite component of the catalyst system are combined in the form of a dual function catalyst composition. This preferred type of catalyst composition consists essentially of an acidic zeolite having between about 0.5 and 30 weight percent (based on the free metal) of a metallic hydrogenation element selected from Group VB, Group VIB and Group VIII metals of the Periodic Table.

The metallic hydrogenation element can be exchanged into the acidic zeolite, impregnated therein or physically admixed therein. For example, a metal element such as platinum can be impregnated in or on the zeolite substrate by treating the zeolite with a platinum metal-containing ion such as is contained in chloroplatinic acid, platinous chloride and various compounds containing the platinum amine complex.

In the case where the metallic hydrogenation element is being exchanged into a zeolite, the preferred exchangeable zeolite cations are hydrogen or a divalent metal such as magnesium, calcium or zinc. In a typical preparation, a zeolite having a silica/alumina ratio above about 10 is prepared in the sodium or potassium form, and the monovalent metal is exchanged out with an ammonium salt. Upon heating the zeolite, the zeolite ammonium ion decomposes to yield a protonic-containing "acidic" zeolite.

Processing Conditions

The present invention process can be conducted advantageously under reaction conditions which are relatively mild in comparison with conventional catalytic hydrocracking parameters. Illustrative of suitable hydrofining conditions for the invention process are the following:

| | | Preferred |
|---|---|---|
| Temperature, °F. | 400–900 | 500–850 |
| Pressure, psig | 100–5000 | 500–3000 |
| Liquid Hourly Space Velocity | 0.1–10 | 0.5–5 |
| Hydrogen/oil, s.c.f./barrel | 300–15,000 | 500–10,000 |

As an illustration of the practice of the invention hydrofining process, under selected processing conditions of temperature and pressure, clarified slurry oil, and water and hydrogen are intimately admixed in contact with the catalyst in a hydrofining zone. Although the process can be conducted batchwise, it is preferred to conduct the process continuously in an enclosed reactor system, with the hydrocarbon stream flowing downward through the vessel. Under the mild hydrofining conditions contemplated for the practice of the invention process, thermal cracking is inhibited and conversion of liquid hydrocarbons to gaseous waste products is minimized, and deposition of coke on the catalyst suppressed.

The total product effluent from the hydrofining zone is passed into a suitable separator from which the normal liquid hydrocarbons are recovered, and the hydrogen-rich gaseous phase is subjected to condensation and water washing to remove ammonia, hydrogen sulfide and other contaminants.

In the above described continuous processing, it is particularly preferred to introduce the hydrogen and water as a gasiform mixture which moves upward in a countercurrent interaction with the hydrocarbon stream.

In another of its embodiments, with modification the invention process is applicable for denitrification of raw coal. The modified process comprises the introduction of a slurry of pulverized coal, water and liquefaction solvent into a hydrofining zone, wherein the slurry is contacted with solid catalyst and gaseous hydrogen. The moisture in the coal is calculated as a portion of the water content of the system. A liquid-fluidized bed reactor system as described in U.S. Pat. No. 3,488,280 is suitable for the coal hydrofining procedure contemplated by the present invention.

The embodiment contemplated involves a process for denitrification of coal which comprises (1) admixing comminuted coal with a liquefaction solvent, and (2) contacting the admixture with hydrogen and water at a temperature between about 500° F. and 850° F. in the presence of a hydrogenation catalyst and an acidic zeolite catalyst.

Essentially any type of normally solid coal can be hydrofined by the invention process, e.g., semi-anthracite, bituminous, semi-bituminous, sub-bituminous, lignite, peat, and the like. The coal is crushed in any conventional manner to a size which is convenient for handling and processing. A suitable particle size is that which passes through an 8 mesh Tyler sieve.

The liquefaction solvent which is slurried with the pulverized coal is preferably a hydrogen-donor liquid medium such as tetralin or partially hydrogenated anthracene and the like. A particularly excellent type of hydrogen-donor liquefaction solvent is a petroleum refinery residuum fraction such as FCC main column bottoms and TCC syntower bottoms.

In a preferred embodiment, the invention contemplates a process for denitrification of raw coal which comprises (1) admixing comminuted raw coal which a petroleum refinery residuum solvent to form a slurry, and (2) heating the slurry at a temperature between about 500° F. and 850° F. for a period of time between about 0.5 and 3 hours, in the presence of hydrogen and between about 0.1 and 5 weight percent of water, based on the combined weight of raw coal and residuum solvent, and in contact with a steam stable acidic zeolite catalyst having a metallic hydrogenation component incorporated therein.

The liquefaction solvent and the coal can be admixed in a weight ratio between about 0.5 and 5 to 1 of solvent to coal.

The coal hydrofining process can be conducted at a pressure between about 500 and 5000 psig, and with a ratio of hydrogen to the combined weight of coal and liquefaction solvent in the range between 1000 and 20,000 s.c.f./ton.

The following examples are further illustrative of the present invention. The reactants and other specific ingredients are presented as being typical, and various modifications can be devised in view of the foregoing disclosure within the scope of the invention.

EXAMPLE I

This Example illustrates the denitrification of a petroleum refinery residuum fraction.

The feedstock employed is an FCC main column bottoms having a boiling range above about 800° F., and a pour point, °F. of 50. The feedstock is contaminated by the presence of about 0.8 weight percent of nitrogen and 1.6 weight percent sulfur.

The hydrofining reactor employed contains a bed of acidic ZSM-5 dual function catalyst which has 2% nickel and 15% molybdenum (calculated as elemental metal) incorporated therein. During the hydrofining cycle, the catalyst bed is maintained at about 750° F.

The feedstock is preheated and entered into the upper end of the reactor vessel, and passed downward through the catalyst bed at a LHSV of about 2. A gaseous mixture of hydrogen and steam is entered near the lower end of the reactor and passed upward once-through the catalyst bed countercurrently to the feedstock flow. The quantity of steam is calculated to provide a total water proportion of about 5 weight percent, based on the weight of feedstock. The amount of hydrogen is calculated at the rate of about 5000 s.c.f./barrel. The pressure of the hydrofining zone is maintained at a level of about 2500 psig.

The overhead vapor stream is passed through a liquid-gas separation from which entrained normally liquid hydrocarbons are removed and combined with the feedstock product effluent. The hydrogen-rich gaseous phase containing hydrogen sulfide, ammonia, carbon oxide and light hydrocarbons is withdrawn, and treated to recover the hydrogen for recycle. A light hydrocarbon fraction from the liquid-gas separator is subjected to centrifugal separation to remove a metal-containing sludge.

The feedstock product effluent is passed through a high-pressure separator which is maintained at a pressure of about 3000 psig and a temperature of about 100° F. The recovered hydrocarbon product effluent has a nitrogen content of 0.16 weight percent and a sulfur content of 0.94 weight percent.

It is estimated that the presence of water in a hydrofining system in conjunction with a dual-function acidic zeolite catalyst system in accordance with the present invention process results in a reduced hydrogen consumption of at least 5–30 percent. In a case where a feedstock initially contains a relatively low content of nitrogen and sulfur contaminants, it is theoretically possible to conduct the hydrofining process with a resultant net gain of hydrogen because of the presence of in situ hydrogen generating precursors.

EXAMPLE II

This Example illustrates the liquefaction and hydrofining of coal in a batch process.

An autoclave is charged with 100 parts of pulverized Pittsburgh #8 bituminous coal, 100 parts of tetralin, 10 parts of water, and 3 parts of dual-function acidic ZSM-5 zeolite catalyst which contains 15 percent by weight of molybdenum.

The autoclave is pressured to 1000 psig, and the contents are heated at a temperature of 600° F. for 2.5 hours.

Before the hydrofining treatment, the coal (moisture-free basis) has a nitrogen content of 1.8 weight percent and a sulfur content of 1.2 weight percent. After the hydrofining treatment, the solvent refined coal recovered from the product mixture had a nitrogen content of 0.2 weight percent and a sulfur content of 0.4 percent.

What is claimed is:

1. A process for denitrification of a heavy hydrocarbon feedstock having a boiling range above about 400° F. which comprises hydrofining the feedstock at a temperature between about 500° F. and 850° F. in the presence of between about 0.1 and 5 weight percent of water, based on the weight of feedstock, and in contact with an acidic zeolite catalyst having a metallic hydrogenation component incorporated therein.

2. A process in accordance with claim 1 wherein the feedstock is a petroleum refinery residuum fraction.

3. A process in accordance with claim 1 wherein the feedstock is a heavy hydrocarbon mixture derived from oil shale, tar sands or coal liquefaction.

4. A process in accordance with claim 1 wherein the hydrofining is conducted with a hydrogen/feedstock ratio between about 500 and 10,000 s.c.f./barrel.

5. A process in accordance with claim 1 wherein the hydrofining is conducted at a pressure between about 500 and 3000 psig.

6. A process in accordance with claim 1 wherein the catalyst is a steam stable acidic zeolite having a silica/alumina ratio above about 10.

7. A process in accordance with claim 1 wherein the catalyst is a steam stable acidic zeolite having an alpha value in the range between about 1 and 1000.

8. A process in accordance with claim 1 wherein the catalyst is a steam stable acidic zeolite having incorporated therein a metallic hydrogenation component selected from the group consisting of Group VB, Group VIB and Group VIII metals.

9. A process in accordance with claim 1 wherein the nitrogen content of the feedstock is reduced by at least 40 percent under the hydrofining conditions.

10. A process for denitrification of raw coal which comprises (1) admixing comminuted raw coal with a petroleum refinery residuum solvent to form a slurry, and (2) heating the slurry at a temperature between about 500° F. and 850° F. for a period of time between about 0.5 and 3 hours, in the presence of hydrogen and between about 0.1 and 20 weight percent of water, based on the combined weight of raw coal and residuum solvent, and in contact with a steam stable acidic zeolite catalyst having a metallic hydrogenation component incorporated therein.

11. A process in accordance with claim 10 wherein the residuum solvent and the coal are admixed in a weight ratio between about 0.5 and 5 and 1 of solvent to coal.

12. A process in accordance with claim 10 wherein the residuum solvent is selected from FCC main column bottoms and TCC syntower bottoms.

13. A process in accordance with claim 12 wherein the ratio of hydrogen to the combined weight of coal and solvent is between about 1000 and 20,000 s.c.f./ton.

14. A process in accordance with claim 10 wherein the denitrification is conducted at a pressure between about 500 and 5000 psig.

15. A process in accordance with claim 10 wherein the catalyst is a steam stable acidic zeolite having a silica/alumina ratio above about 10.

16. A process in accordance with claim 10 wherein the catalyst is a steam stable acidic zeolite having an alpha value in the range between about 1 and 1000.

17. A process for denitrification of coal which comprises (1) admixing comminuted coal with a liquefaction solvent, and (2) contacting the admixture with hydrogen and water at a temperature between about 500° F. and 850° F. in the presence of a hydrogenation catalyst and an acidic zeolite catalyst.

* * * * *